US008657462B2

(12) United States Patent
Schwalenberg et al.

(10) Patent No.: US 8,657,462 B2
(45) Date of Patent: Feb. 25, 2014

(54) ILLUMINATION MODULE

(75) Inventors: Simon Schwalenberg, Donaustauf (DE); Harald Stoyan, Rettenbach (DE); Hubertus Breier, Dettingen (DE); Klaus Burkard, Regensburg (DE)

(73) Assignee: OSRAM Gesellschaft mit beschraenkter Haftung, Munich (DE)

( * ) Notice: Subject to any disclaimer, the term of this patent is extended or adjusted under 35 U.S.C. 154(b) by 991 days.

(21) Appl. No.: 12/677,821

(22) PCT Filed: Sep. 12, 2008

(86) PCT No.: PCT/EP2008/007588

§ 371 (c)(1),
(2), (4) Date: Mar. 12, 2010

(87) PCT Pub. No.: WO2009/036934

PCT Pub. Date: Mar. 26, 2009

(65) Prior Publication Data

US 2011/0285298 A1 Nov. 24, 2011

(30) Foreign Application Priority Data

Sep. 14, 2007 (DE) ..... 10 2007 043 861

(51) Int. Cl.
*F21S 4/00* (2006.01)

(52) U.S. Cl.
USPC ..... 362/219; 362/236; 362/365; 362/374; 362/547; 362/97.3; 315/312; 315/318; 315/294

(58) Field of Classification Search
USPC ..... 362/227, 236, 238, 246, 249.02, 294, 362/241, 247, 362, 364, 365, 373, 374, 543, 362/545, 547, 800, 217.01, 219, 97.3; 315/291, 294, 297, 312, 318
See application file for complete search history.

(56) References Cited

U.S. PATENT DOCUMENTS

| | | | | |
|---|---|---|---|---|
| 3,789,211 | A | 1/1974 | Kramer | |
| 6,502,962 | B1 | 1/2003 | Menke et al. | |
| 6,536,914 | B2 * | 3/2003 | Hoelen et al. | 362/231 |
| 6,566,824 | B2 | 5/2003 | Panagotacos et al. | |
| 7,165,863 | B1 | 1/2007 | Thomas et al. | |
| 7,169,245 | B2 * | 1/2007 | Murray et al. | 156/73.1 |
| 7,306,353 | B2 * | 12/2007 | Popovich et al. | 362/373 |
| 7,872,278 | B2 * | 1/2011 | Stoyan | 257/99 |
| 7,918,591 | B2 * | 4/2011 | Lynch | 362/365 |
| 8,159,147 | B2 * | 4/2012 | Schwalenberg et al. | 315/294 |
| 2003/0048641 | A1 | 3/2003 | Alexanderson et al. | |

(Continued)

FOREIGN PATENT DOCUMENTS

| | | | |
|---|---|---|---|
| CN | 2723812 | Y | 9/2005 |
| DE | 19528459 | C2 | 2/1997 |

(Continued)

OTHER PUBLICATIONS

Machine English translation of DE10103611A1.

(Continued)

*Primary Examiner* — Haiss Philogene

(57) ABSTRACT

A luminous module for a luminous chain may include at least one light source; and at least one electrical connection configured to supply the at least one light source, wherein the luminous module includes a heat sink.

17 Claims, 3 Drawing Sheets

(56) References Cited

U.S. PATENT DOCUMENTS

| | | | |
|---|---|---|---|
| 2004/0222516 | A1 | 11/2004 | Lin et al. |
| 2006/0227554 | A1 | 10/2006 | Yu |
| 2007/0164303 | A1 | 7/2007 | Ho |
| 2007/0190845 | A1 | 8/2007 | Mrakovich et al. |
| 2008/0025022 | A1 | 1/2008 | Schinzel et al. |

FOREIGN PATENT DOCUMENTS

| | | | |
|---|---|---|---|
| DE | 10103611 | A1 | 8/2002 |
| DE | 10110835 | B4 | 9/2002 |
| DE | 10302231 | A1 | 7/2004 |
| DE | 102004004777 | A1 | 9/2005 |
| DE | 102007002838 | A1 | 3/2008 |
| JP | 2005122945 | A | 5/2005 |

OTHER PUBLICATIONS

English language abstract of JP2005-122945A.
International Search Report of PCT/EP2008/007588 dated Mar. 16, 2009.
English language abstract of DE 10 2007 002 838 A1.
English language abstract of DE 101 10 835 B4.
English machine translation of DE 195 28 459 C2.
English language abstract of DE 103 02 231 A1.
English-language translation of International Preliminary Report on Patentability issued for PCT/ EP2008/007588 on Apr. 7, 2010.
English language abstract of CN 2723812 Y.

* cited by examiner

ILLUMINATION MODULE

RELATED APPLICATIONS

The present application is a national stage entry according to 35 U.S.C. §371 of PCT application No.: PCT/EP2008/007588 filed on Sep. 12, 2008, which claims priority from German application No.: 10 2007 043 861.5 filed on Sep. 14, 2007.

TECHNICAL FIELD

Various embodiments relate to a luminous module for a luminous chain and to a luminous chain having such a luminous module, e.g. for use in light boxes.

BACKGROUND

DE 10 2004 004 777 A1 discloses a deformable luminous chain having a plurality of luminous modules on which there is arranged in each case at least one optical emitter, and are connected to form a chain via two electrical power supply wires. The electrical power supply wires run without interruption via all the modules of the chain and interconnect the modules.

U.S. Pat. No. 6,566,824 B2 discloses a lighting device that has a lighting segment that includes a multiplicity of lighting sections. Each of the sections includes a printed circuit board having a semiconductor light emitter mounted thereon. The sections are interconnected by printed circuit board connectors that connect the printed circuit boards in series with edges of neighboring printed circuit boards next to one another. The printed circuit board connectors are deformable in order to change the alignment as a reaction to an applied force. The sections are interconnected electrically such that the semiconductor light emitters are connected electrically in series. The segment has a current regulator that regulates the current through the semiconductor light emitter.

SUMMARY

Various embodiments provide a possibility for more uniform and more reliable lighting, for example backlighting of luminous surfaces, by means of light chains.

The luminous module for a luminous chain has at least one light source and at least one electrical connection for supplying the at least one light source. The luminous module also has a heat sink.

As a result of the heat sink being integrated in the luminous module, the latter is cooled better, and so a service life is lengthened. Furthermore, a user need no longer be concerned, or no longer be concerned as intensively, with the cooling of a luminous chain, and so user friendliness is increased. This holds true particularly when the luminous chain is accommodated in a so-called light box, which results in a uniform backlighting of luminous surfaces (e.g. advertising boxes or luminous letters) with improved and simplified cooling and thus increased reliability.

Preferably, the light sources are arranged on a front side of a printed circuit board, and the heat sink is connected to a rear side of the printed circuit board.

Preferably, the heat sink is fastened on the printed circuit board by means of an adhesive agent. The adhesive agent is preferably a thermally conductive adhesive connection and can be electrically conductive or insulating, as required.

As an alternative, the heat sink can be fastened on the printed circuit board by means of a mechanical connecting element, an interlayer of TIM material preferably being arranged between the heat sink and the printed circuit board.

A luminous module in which the heat sink has holding lugs for fastening the luminous module is preferred. In this case, the heat sink is preferably embodied in an elongate form. The form of the heat sink preferably corresponds to the printed circuit board dimensions. The holding lugs then preferably start at a side edge in the region of the center of the associated longitudinal axis. The elongate form used can be for example an oval, a polygonal or a rectangular basic form, or mixed forms thereof, the contour of the side edges being able to deviate locally therefrom. However, heat sink and/or printed circuit board are not restricted to an elongate form, but rather can be formed as desired, e.g. in a round or square form. Moreover, the holding lugs can be situated at any desired position.

For effective cooling, the heat sink preferably has an arrangement composed of cooling projections, in particular cooling pins. It is particularly preferred when the height of the holding lugs is smaller than the height of the cooling projections, in particular pins. A luminous module in which the holding lugs and the cooling projections, in particular pins have a height difference of between approximately 0.05 and approximately 0.3 mm is particularly preferred.

Furthermore, a luminous module in which the heat sink consists of aluminum, in particular of aluminum having a degree of purity above 95%, especially of above 98%, is preferred. Generally, the heat sink can consist of a material having a high thermal conductivity, for example using copper, zinc and/or magnesium. Specifically, the heat sink has an arrangement composed of regularly arranged pins having the same height, said arrangement being placed on a plate.

The heat sink is preferably surface-treated, for example coated or anodically oxidized, in order to increase the thermal emittance.

The luminous module can have one or more monochromatic, for example, white, light sources. The luminous module preferably has a red light-emitting diode, a blue light-emitting diode and two green light-emitting diodes.

The light sources are preferably light-emitting diodes, but can also include different luminous means such as incandescent or fluorescent lamps, and so on.

The luminous module can have a common optics, in particular diffusing optics, for example a common diffusing lens, for some or all of the light sources mounted on it. In order to reduce the installation height, however, it is particularly preferred when each light source is assigned a dedicated diffusing optics for diffusing the light emitted by the respective light source. Instead of a diffusing lens, it is also possible to use any other suitable light-diffusing element. The diffusing lens is preferably widely diffusing, for example a so-called ARGUS lens, such that a widely uniform light emission results with a low design height.

A coupling-out optics can also be used for increasing the efficiency.

A luminous module in which the printed circuit board or the substrate or the construction technology has a good thermal conductivity or low thermal resistance is preferred. A luminous module in which the printed circuit board is a metal-core printed circuit board is particularly preferred.

It is preferred when the luminous module has a cover at least for covering the printed circuit board. In order to improve the uniformity of a light emission, in particular from light boxes, the cover has externally a reflectivity of more than 60% in the visible region of the light. In this case, it is preferred for the cover to be embodied in such a way that it at least partly laterally covers the heat sink in the emplaced state.

The cover can consist of plastic or metal. It may be preferred, particularly in the case of a use in interior spaces, if the cover in the emplaced state does not close off an underlying interior space of the luminous module in an airtight fashion. Advantageously, for mechanical protection and for corrosion protection, electrical contacts of current-carrying parts on the printed circuit board are then coated with a lacquer layer, in particular with a lacquer having a viscosity in the range of 100-3000 mPas during application, in order to be able to be distributed with uniform coverage.

For the purpose of being used as a non-terminal (middle) chain element of the luminous chain, the luminous module has at least two electrically interconnected electrical connections for supplying the at least one light source. These electrical connections are mostly fed by a single current source and constitute parts of an electrically continuous current lead.

For the purpose of flexible color selection of the (total) light emitted by the luminous module, use is preferably made of at least one external voltage source whose voltage can be pulse-width modulated.

The object is also achieved by means of a luminous chain having at least two series-connected luminous modules of the above type.

The associated luminous modules are preferably connected such that a set of light sources including in each case one light source of the luminous modules is connected electrically in series, that is to say by means of a so-called strand. It is then particularly preferred when the luminous modules are connected such that a set of light sources of the same color including in each case one light source of the luminous modules is electrically connected in series.

Particular preference goes to differently colored light sources and/or light sources with associated optics, that can produce a white light by additive color mixing. This can be, for example, a combination of light sources of the arrangement RGB, or else RRGB, RGGB, RRGGB, and so on. In addition, it is possible by means of light sources of different color to achieve by suitable driving a light output of the luminous module with variable color that can be set in a targeted fashion.

The luminous modules are generally preferably connected such that a power loss of a driver circuit for the light sources is distributed over the luminous modules in a substantially uniform fashion. The luminous module, which is suitable, in particular, for use in the luminous chain, preferably has for this purpose at least one continuous light-source line with at least one interposed light source, in particular at least one light-emitting diode. Continuous is understood to mean here in particular an electrical line that has at least one input terminal and one output terminal at the luminous module, that is to say is led through the luminous module. The luminous module further has at least one continuous light-source supply line for supplying power to the light source, and at least one continuous driver supply line for operating at least one driver circuit for driving the at least one light source. A driver circuit feeds the at least one continuous driver supply line.

A luminous chain of such luminous modules has a plurality of series-connected luminous modules of the above type, where in the case of at least one luminous module, in particular a terminal luminous module, the light-source supply line and the light-source line are interconnected electrically. In this luminous module, in this way the (accumulated) summation current of the driver (partial) circuits that is carried via the light-source supply line is hereby fed into the light sources connected in series in the light-source line.

From another point of view, at least two of the luminous modules of the luminous chain in each case have at least one set including at least one light source and a driver circuit for driving the at least one light source. The driver circuits of a set of the respective luminous modules are connected electrically in parallel with one another, and the light sources of this one set ("strand") of the respective luminous modules are connected electrically in series with one another. The driver outputs of the driver circuits are combined at a node for jointly supplying current to all the light sources of said one set.

It is advantageous when the driver circuit has an electrical resistor and/or at least one transistor and/or at least one diode. It is furthermore advantageous when the driver circuit is a current control circuit, in particular a current stabilizer circuit. The driver output is advantageously, but not necessarily, a current output.

It is advantageous for a simple construction when the driver circuit is connected electrically by one of its supply inputs to a cathode side of the associated light source, that is to say the light source present on the same luminous module, since this results in a higher potential difference than in the case of connection to the anode side. However, it is also possible in principle to connect the driver circuit electrically to an anode side of the light source. It can, alternatively also be advantageous when the driver circuit is connected to a dedicated driver supply line for each of its supply inputs.

In order to increase the luminous intensity, it can be advantageous when each luminous module has a plurality of light sources per set, in particular light-emitting diodes having the same light spectrum, for example, white LEDs, or ones of the same color, in particular two green LEDs.

For the purpose of, in particular, flexible, color setting and/or of increasing the luminous intensity, it is advantageous when each luminous module has a plurality of sets of at least one light source and one driver circuit for supplying current to the at least one light source. These interconnected sets correspond to the strands.

Particularly for the purpose of variable setting of a color emission, it is advantageous when at least three sets of at least one light source and one associated driver circuit are present (corresponding to at least three strands), the light sources of at least two sets or strands in each case being of different colors with respect to one another.

BRIEF DESCRIPTION OF THE DRAWINGS

The luminous module is described more precisely below in a schematic fashion with the aid of various embodiments. In the drawings, like reference characters generally refer to the same parts throughout the different views. The drawings are not necessarily to scale, emphasis instead generally being placed upon illustrating the principles of the invention. In the following description, various embodiments of the invention are described with reference to the following drawings, in which.

DETAILED DESCRIPTION

The following detailed description refers to the accompanying drawings that show, by way of illustration, specific details and embodiments in which the invention may be practiced.

Figure 1:
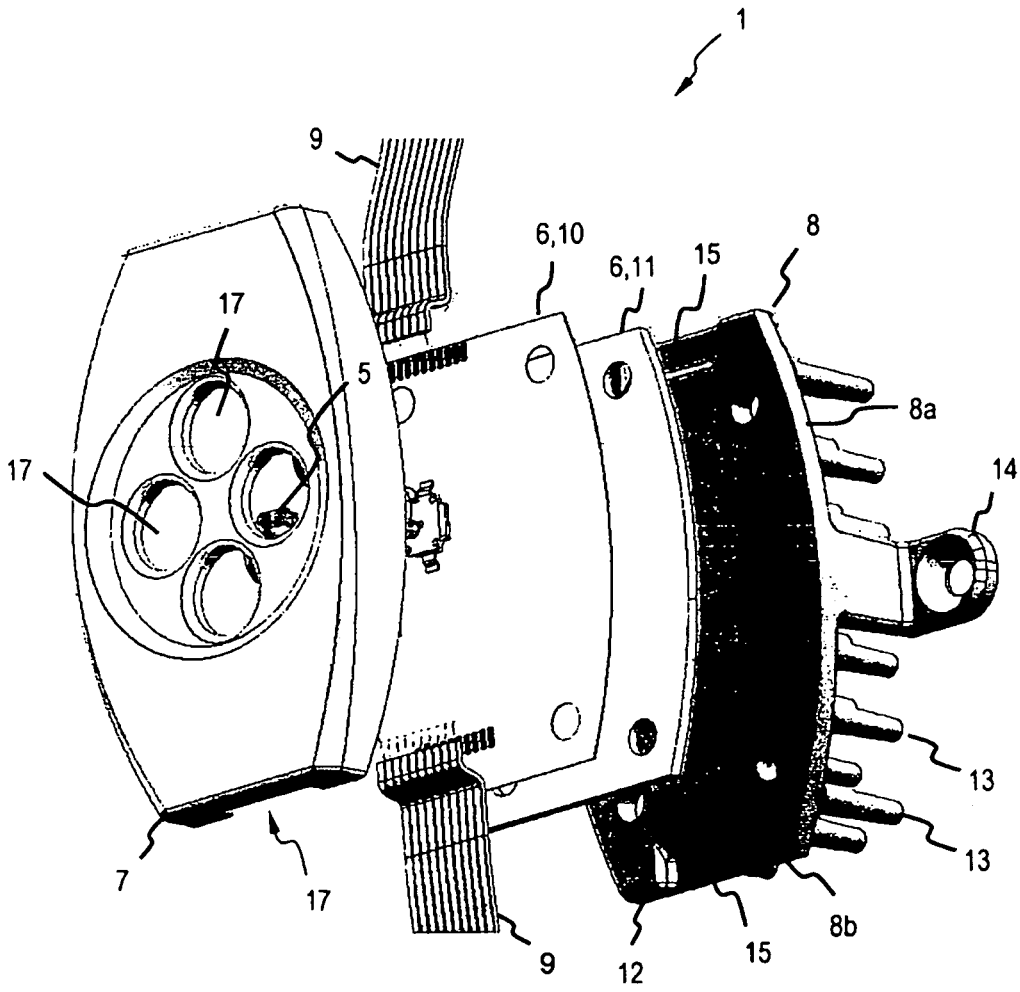
FIG. 1 shows a luminous module in an exploded view from obliquely in front.
Figure 2:
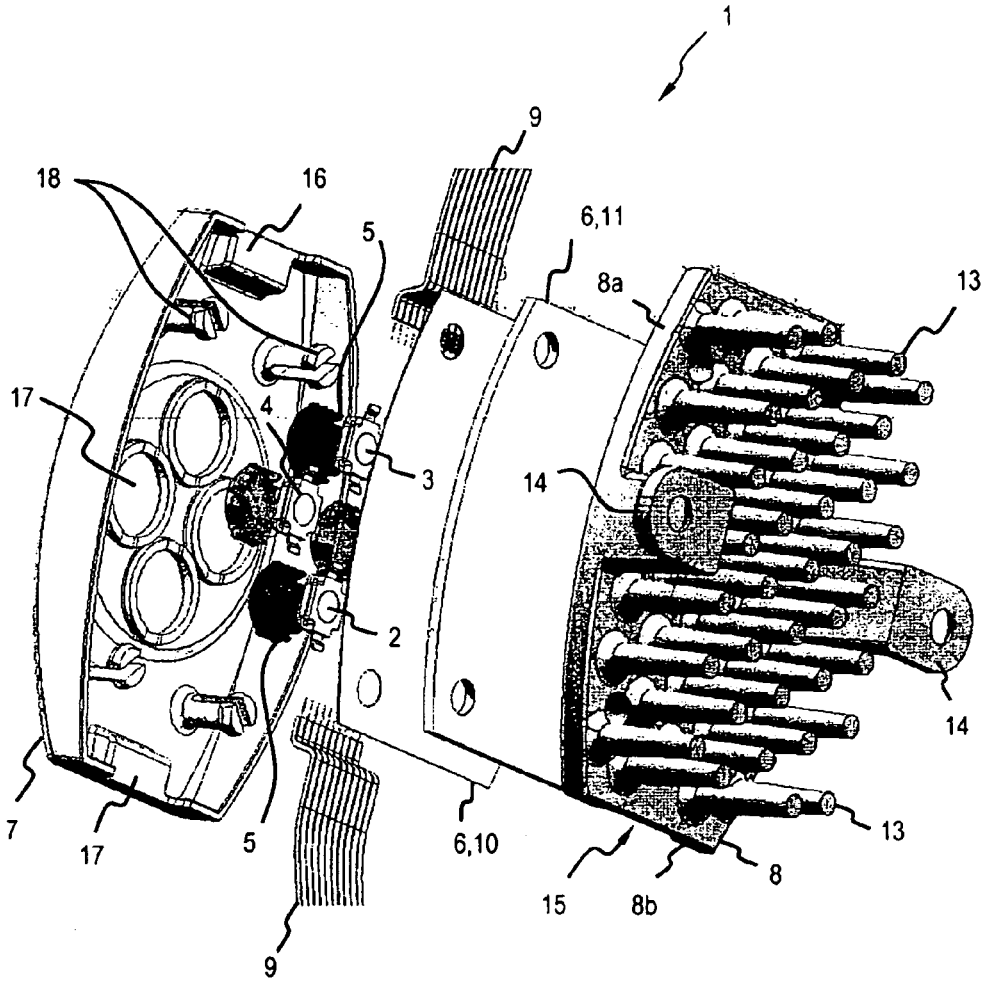
FIG. 2 shows a luminous module from FIG. 1 in an exploded view from obliquely behind.

FIG. 1 and FIG. 2 respectively show a luminous module 1 consisting of a chain of luminous modules 1 interconnected electrically. In the embodiment shown, each module 1/element of the chain has a printed circuit board 6 populated with a plurality of LEDs 2, 3, 4 with respective diffusing optics 5, arranged in the emission direction, and further electronic components (not illustrated). A cover 7 and heat sink 8 are situated on the front and rear side, respectively, of the printed circuit board 6.

In detail, one red LED 2, one blue LED 3 opposite the latter, and two green LEDs 4 (only one of which is illustrated) arranged adjacent thereto are used per module 1. As a result, the total luminous area of the LEDs is chosen to be larger for green than for red and blue (luminous area ratio green:red: blue=2:1:1). This has an advantageous effect on the color mixing for white light since the green proportion is particularly high for a white mixing. As a result, it is possible to use comparatively inexpensive LEDs 2,3,4 which, moreover, do not have to be driven up to their power limits. It is particularly suitable for this purpose to drive the LEDs 2,3,4 with a luminous proportion of green:blue:red of 60:30:10. Apart from white, all other possible color mixings can be produced by suitable driving of the LEDs 2,3,4 by means of a pulse-width-modulated supply current.

Along the chain, LEDs of the same color 2,3,4 are connected electrically in series (so-called "strands"), two separate series circuits (that is to say two strands) being used for the color green. The current per strand is set by means of a parallel circuit of electronic components, for example ICs and resistors (not illustrated), which convert the excess power which may be different on account of the production-dictated different forward voltages of the LEDs 2,3,4, into heat. In this case, these components are arranged on the modules 1/printed circuit boards 6 of the chain in order to distribute the heat uniformly over the printed circuit boards 6, which leads to more homogeneous operating conditions of the individual modules 1.

The electrical connection is effected via a single- or multipole-electrical line, for example the ribbon cable 9 shown, or by individual lines, each embodied as a litz wire or a solid wire, for example, which is connected to the circuit board 6. For the purpose of supplying current to a further module (not illustrated), the current supply lines are looped through the circuit board 6 and led as far as another cable terminal, from which in turn a cable 9 leads to the other module. These two cables 9 or electrically connected cable terminals are thus electrically interconnected. However, just one current terminal suffices for supplying current to the module 1.

The LEDs 2,3,4 can be equipped with or without an attached diffusing optics 5 and can be present in housed form (LED chip in a housing) or an unhoused version (just the LED chip). In this embodiment, each of the LEDs 2,3,4 has an identical flat diffusing lens 5 having a wide emission angle. As a result, a possibility for comparatively uniform illumination in conjunction with wide viewing angles can be achieved using simple means. Moreover, the construction shown has only a small structural height in the region of the luminous elements 2,3,4,5.

The circuit board 6 shown is a metal-core printed circuit board, having a structured copper layer on a dielectric 10, for example composed of polyimide or epoxy resin, and also a substrate 11, for example composed of aluminum, copper or some other metal. In this case, the heat generated on the printed circuit board 6 is emitted particularly effectively to the heat sink 8 via the large interface of said printed circuit board.

The heat sink 8 preferably consists of a material having a high thermal conductivity, such as for example aluminum. As an alternative, it is also possible to use heat sinks 8 using copper, zinc and/or magnesium, or generally using materials having good conductivity, such as metals. The heat sink 8 is fitted to the rear side of the circuit board 6 (in an electrically conductive or insulating manner) by means of a thermally conductive adhesive connection. In detail, the heat sink 8 has an arrangement composed of regularly arranged pins 13 having the same height, said arrangement being placed on the rear of a plate 12.

For the purpose of fastening on a mounting surface, for example a wall, the heat sink 8 has holding lugs 14. The arrangement shown here of the holding lugs 14 in the center of the long edges 8*a* or of the longer side edges of the elongate heat sink 8 is particularly advantageous for two reasons: firstly, the distance from the heat sources (LEDs, electrical/electronic components) is then small. This results in a particularly high degree of heating of the holding lugs 14, which provides for additional heat dissipation of the module 1 by thermal conduction via the holding lugs 14 to the mounting surface. Secondly, for cooling by free convection at the heat sink 8, the long heat sink edges 8*a* afford a larger cross-sectional area for the air flowing through (better cooling), and an adverse influence of the holding lugs 14 in this regard has a less pronounced effect than in the case of provision on the short edges 8*b* with a smaller cross-sectional area for the air. This leads to thermal properties of the heat sink 8 which depend to a lesser extent on the orientation of the heat sink 8 (for example vertically or horizontally) on a mounting surface than in the case of holding lugs 14 arranged differently.

The length of the pins 13 is chosen such that they project from the plate 12 further toward the rear than the holding lugs 14 (height difference preferably of 0.05 mm to 0.3 mm). This ensures the contact of one or more pins 13 with the mounting surface and hence an additional heat dissipation by conduction via the bearing areas of the pins 13 on the mounting surface, which is preferably composed of metal. The fastening of the heat sink 8 by means of the holding lugs 14 is realized here by screws, the screw holes of which are illustrated in the holding lugs 14 (not provided with reference symbols).

For better heat dissipation, the heat sink 8 is surface-treated, for example by means of a powder coating or an anodization. This results in a higher thermal emittance than that of the raw material (better system heat dissipation by increased thermal radiation). At the same time, the coating protects the heat sink against harmful environmental influences. A light color with high light reflectance of the coating is advantageous in order to increase the optical properties in the diffusely reflective light box.

The heat sink 8 has a depression 15 in the form of a bead on the short sides 8*b*. In combination with the cover 7, which has a bulge 16 at the corresponding location, a guide channel is created for the cable 9.

In the event of a tensile force on the cable 9 of arbitrary orientation (e.g. upward, downward, toward the right or toward the left), the force is transmitted through said channel to soldering locations of the cable 9 with the printed circuit board 6 in such a way that the force is directed only in a small, as far as possible insensitive angular range with respect to the surface of the printed circuit board. This prevents shear and peel forces on the soldering locations.

The cover 7 consists of UV-stable plastic that can be subjected to thermal loading. A light coloring is advantageous, combined with a reflectivity of more than 60% in the visible region of the light in order to improve the optical properties of the module 1 in the light box. The cover 7 is formed in such a way that it partly laterally conceals the heat sink 8 and thus increases the total reflectivity of the module 1. The cover 7 has cutouts 17 embodied in such a way that the LEDs 2,3,4 can emit their light unimpeded in terms of location and angle. The cover 7 is fastened by means of a snap-action mechanism by means of plastic pins 18 which are led through corresponding holes (not provided with reference symbols) in the printed circuit board 6,10,11 and in the heat sink 8 and latch into place. The cover 7 additionally has the property that it does not close off the underlying interior space of the module 1 in an airtight fashion, but rather allows moisture to enter and exit. The accumulation of condensation water is avoided in this way.

For protection against condensation water/corrosion and harmful gases, the electrical contacts of the current-carrying parts on the circuit board 6, 10 are coated with a lacquer layer. This reduces the risk of the formation of air clearances and creepage paths. In the embodiment shown, the lacquer has fluorescent properties for quality inspection. The viscosity of the lacquer is preferably chosen such that it achieves a complete wetting of the contacts via the effect of capillary action. Viscosities in the range of 100-500 mPas are advantageous.

Figure 3:
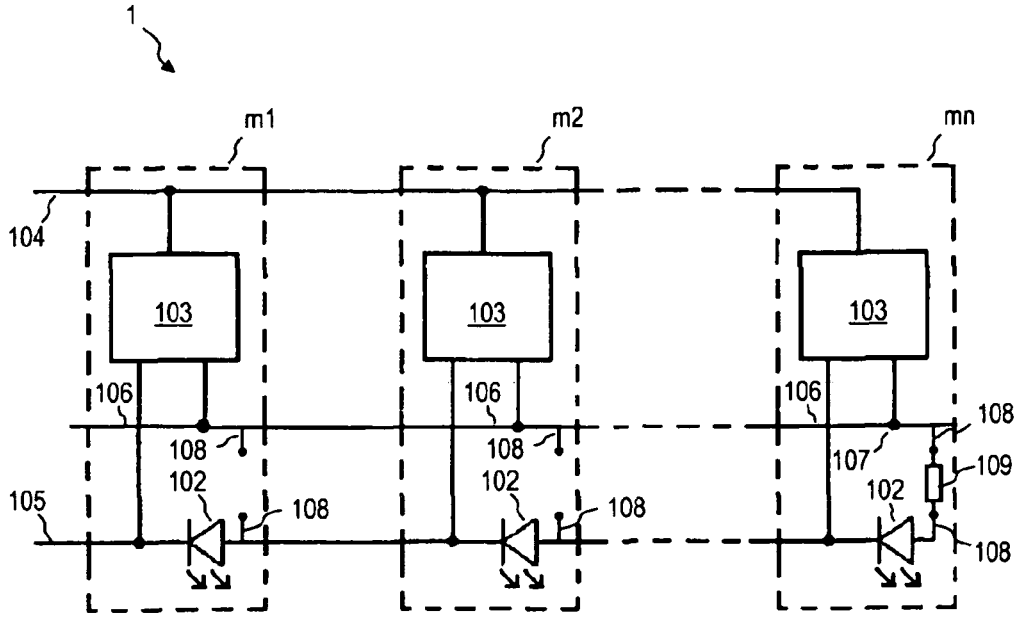
FIG. 3 shows schematically a circuit of a luminous chain with a plurality of luminous modules with a distributed driver circuit.

FIG. 3 shows a luminous chain 101, e.g. for backlighting luminous zones, including a plurality of n serially interconnected luminous modules m1, m2, . . . , mn. The luminous modules have the same structural basic construction. Each of the luminous modules m1, m2, . . . , mn has, for example, a light emitting diode 102 and an LED driver circuit in the form of a current control circuit 103 for supplying current to the light emitting diode(s) 102. The current control circuit 103 is attached electrically between two respectively continuous driver supply lines 104, 105. One of these supply lines 105 corresponds to a continuous light-source line 105 in which the LED 102 is interposed. In the embodiment shown, the current control circuit 103 is electrically connected by one of its supply inputs to a cathode side of the associated LED 102. By virtue of the tapping off of the required voltage potential—which is lower here in comparison with the driver supply line 104—at the cathode of the LED 102 positioned on the respective luminous module m1, m2, . . . , mn, a connecting line between the luminous modules m1, m2, . . . , mn is advantageously saved.

Driver outputs of the control circuit 103 are in each case electrically connected to a continuous light source supply line 106. On the luminous modules m1, m2, . . . , mn−1, the driver outputs are not led to the LED 102, but rather are connected via the light-source supply line 106. It is only on the last, that is to say terminally situated, luminous module mn that the light-source supply line 106 is electrically connected to the light-source line 105.

In other words, the partial currents of the individual control circuits 103 electrically connected in parallel are all combined at a node 107 on the terminally situated luminous module mn and the summation current is then conducted through the series-connected LEDs 102.

The luminous module mn in which the light-source supply line 6 is electrically connected to the light-source line 105 can be derived for example from the basic form of the other luminous modules m1, m2, . . . by inserting a bridge 109 between contacts 108 of the light source supply line 106 and of the light-source line 105 which are open in the basic form.

As an alternative, all the luminous modules can correspond to the basic form with open contacts, wherein, for operation of the luminous chain, the free terminal of the light-source supply line 106 of the terminally situated luminous module is electrically connected to the free terminal of the light-source line 105. This variant has the advantage that the length of the luminous chain can be adapted flexibly and in the field and is essentially only limited by the maximum power consumption.

The luminous chain 101 shown has the advantage that, firstly, there is no need for a separate module for driving the light emitting diodes 102 and, secondly, on account of the distribution of the driver components on the individual luminous modules m1, m2, . . . , mn that are separated from one another at least thermally, but usually also spatially, the power loss which occurs and which is converted into heat is likewise distributed on the individual luminous modules m1, m2, . . . , mn. This leads to more homogeneous operating conditions of the individual LEDs 102. Power loss fluctuations that occur on account of fluctuations in the electrical parameters of the LEDs 102 therefore do not appear at points at a location, which advantageously attenuates a point-like heating and the influence thereof on the optical parameters of the LEDs 102.

The electrical concatenation of LEDs 102 that is shown can also be referred to as a strand. The arrangement shown then corresponds in other words to an LED strand on the luminous chain 1 with a distributed driver circuit.

It goes without saying that the present invention is not restricted to the embodiments shown.

Alternatively it is also possible to use monochromatic LEDs, for example, also white shining LEDs. The number and color of the LEDs on a module is not restricted and can, for example, also be one.

Furthermore, the holding lugs need not be screwed, they can, rather, be fastened on the mounting surface in any suitable way desired. Thus, the heat sink can also be formed such that it can latch or be clipped into a previously mounted guide rail on the mounting surface.

Instead of being connected to the printed circuit board by means of an adhesive connection, the heat sink can also, for example, be connected by means of a screwed or riveted connection as well as preferably a further interlayer composed of thermally conductive and/or electrically insulating material (so-called TIM material).

Alternatively, instead of making use of metal-core printed circuit boards it is also possible to use printed circuit board materials such as FR4 or a so-called Flex Foil.

In addition, the bulging of the cover can alternatively be selected such that it exerts on the cable a force that fixes or clamps the cable in the channel. Furthermore, fixing of the cable can also be achieved without a bead in the heat sink, for example by forming in the cover, retainers that press the cable down onto the flat heat sink surface.

Instead of consisting of plastic, it is also possible for the cover to consist, for example, of metal, and thus to act as an additional heat sink element.

It is also possible to use non-fluorescent protective lacquers. Particularly for application in interior spaces, it is also possible to dispense with a protective lacquer.

Alternatively, instead of being fastened by the plastic pins the cover can also be fastened by means of the screws or rivets, for example.

A possible, nonrestrictive application of the luminous module and/or the chain consists in mounting it on a rear wall (for example an aluminum plate) inside a diffusely scatteringly clad Plexiglas box (so-called "light box") or inside advertising letters for the so-called "architectural backlighting".

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

LIST OF REFERENCE SYMBOLS

1 Luminous module
2 Red LED
3 Blue LED
4 Green LED
5 Diffusing optics
6 Printed circuit board
7 Cover
8 Heat sink
8*a* Long edge
8*b* Short edge
9 Cable
10 Dielectric
11 Substrate
12 Plate
13 Pin
14 Holding lug
15 Depression
16 Bulge
17 Cutout
18 Plastic pin
101 Luminous chain
102 LED
103 Control circuit
104 Driver supply line
105 Driver supply line/light-source line
106 Light-source supply line
107 Combining node
108 Contacts
109 Bridges
m1-mn Luminous module

The invention claimed is:

1. A luminous module for a luminous chain, comprising: at least one light source; and at least one electrical connection configured to supply the at least one light source, wherein the luminous module comprises a heat sink, wherein the heat sink comprises holding lugs for fastening the luminous module; and wherein the heat sink is embodied in an elongate form, the holding lugs starting at a side edge in the region of the center of the associated longitudinal axis, wherein the heat sink has an arrangement composed of pins, and the height of the holding lugs is smaller than the height of the pins.

2. The luminous module as claimed in claim 1, wherein the light sources are arranged on a front side of a printed circuit board and the heat sink is connected to a rear side of the printed circuit board.

3. The luminous module as claimed in claim 1, wherein the heat sink has a bright color with a high light reflectance.

4. The luminous module as claimed in claim 2, wherein the heat sink is fastened on the printed circuit board by means of a mechanical connecting element, an interlayer of TIM material being arranged between the heat sink and the printed circuit board.

5. The luminous module as claimed in claim 1, having as light source a red light-emitting diode, a blue light-emitting diode and two green light-emitting diodes.

6. The luminous module as claimed in claim 1, wherein each light source is assigned a diffusing optics for diffusing the light emitted by the respective light source.

7. The luminous module as claimed in claim 2, wherein the heat sink is fastened on the printed circuit board by means of an adhesive agent; and wherein the printed circuit board is a metal core printed circuit board.

8. The luminous module as claimed in claim 1, wherein the holding lugs and the pins have a height difference of between approximately 0.05 to approximately 0.3 mm.

9. The luminous module as claimed in claim 2, wherein the heat sink is fastened on the printed circuit board by means of an adhesive agent; the luminous module further comprising a cover at least for covering the printed circuit board.

10. A luminous chain, comprising: at least two series-connected luminous modules, each luminous module comprising: at least one light source; at least one electrical connection configured to supply the at least one light source, wherein the luminous module comprises a heat sink, wherein at least two of the luminous modules have at least one set comprising at least one light source and a driver circuit for driving the at least one light source, and the driver circuits of one set of the respective luminous modules are connected electrically in parallel with one another, and the light sources of said one set of the respective luminous modules are connected electrically in series with one another, and the driver outputs of the driver circuits are combined at a node for jointly supplying current to all the light sources of said one set.

11. The luminous chain as claimed in claim 10, wherein the luminous modules are connected such that a set of light sources comprising in each case one light source of the luminous modules is connected electrically in series.

12. The luminous chain as claimed in claim 11, wherein the luminous modules are connected such that a set of light sources of the same color comprising in each case one light source of the luminous modules is connected electrically in series.

13. The luminous chain as claimed in claim 10, wherein the luminous modules are connected such that a power loss of a driver circuit for the light sources is distributed over the luminous modules in a substantially uniform fashion.

14. The luminous chain as claimed in claim 10, wherein the driver circuit is a current control circuit or a current stabilizer circuit.

15. A luminous module for a luminous chain, comprising: at least one light source; and at least one electrical connection configured to supply the at least one light source, wherein the luminous module comprises a heat sink, wherein the light sources are arranged on a front side of a printed circuit board and the heat sink is connected to a rear side of the printed circuit board, wherein the heat sink is fastened on the printed circuit board by means of an adhesive agent; the luminous module further comprising a cover at least for covering the printed circuit board, wherein on the outside the cover has a reflectivity of more than 60% in the visible region of the light.

16. A luminous module for a luminous chain, comprising: at least one light source; and at least one electrical connection configured to supply the at least one light source, wherein the luminous module comprises a heat sink, wherein the light sources are arranged on a front side of a printed circuit board and the heat sink is connected to a rear side of the printed circuit board, wherein the heat sink is fastened on the printed circuit board by means of an adhesive agent; the luminous module further comprising a cover at least for covering the printed circuit board, wherein the cover in the emplaced state does not close off an underlying interior space of the luminous module in an airtight fashion.

17. A luminous module for a luminous chain, comprising: at least one light source; and at least one electrical connection configured to supply the at least one light source, wherein the luminous module comprises a heat sink, further comprising: at least one continuous light-source line with at least one interposed light source; at least one continuous light-source supply line; at least one continuous driver supply line for operating at least one driver circuit for driving the at least one light source; a driver circuit feeding at least one continuous driver supply line.

* * * * *